US008357000B1

(12) United States Patent
Albrecht et al.

(10) Patent No.: US 8,357,000 B1
(45) Date of Patent: Jan. 22, 2013

(54) FLUID-ISOLATING, SELF-ALIGNING MAKE-BREAK ELECTRICAL CONNECTION

(75) Inventors: Jeffrey Allen Albrecht, Rotterdam, NY (US); Alex Wakulenko, Cohoes, NY (US); Mohammed Badawi, Niskayuna, NY (US); Evan Finn, Berkeley Heights, NJ (US); Joseph Nicoll, East Greenbush, NY (US); Lisa Madigan, Melrose, NY (US); Robert Mysliwiec, Cohoes, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/248,140

(22) Filed: Sep. 29, 2011

(51) Int. Cl.
*H01R 13/64* (2006.01)

(52) U.S. Cl. ..... 439/248

(58) Field of Classification Search ..... 439/248, 439/247, 700

See application file for complete search history.

(56) References Cited

U.S. PATENT DOCUMENTS

| | | | | |
|---|---|---|---|---|
| 4,917,619 | A * | 4/1990 | Nishiwaki | 439/191 |
| 5,234,353 | A * | 8/1993 | Scholz et al. | 439/289 |
| 7,467,961 | B2 * | 12/2008 | Kuo | 439/248 |
| 7,518,389 | B2 * | 4/2009 | Goto | 324/750.05 |
| 8,210,861 | B2 * | 7/2012 | Tanis et al. | 439/248 |
| 8,231,398 | B2 * | 7/2012 | Rosenberger | 439/247 |

* cited by examiner

*Primary Examiner* — Neil Abrams
*Assistant Examiner* — Phuongchi Nguyen
(74) *Attorney, Agent, or Firm* — Michael C. Sachs

(57) ABSTRACT

An electrical make-break connection for an apparatus having a recoiling portion and a non-recoiling portion may include a non-recoiling assembly fixed to the non-recoiling portion and a recoiling assembly fixed to the recoiling portion. Each of the non-recoiling and recoiling assemblies may include a mounting bracket and an electrical contact assembly disposed in the mounting bracket. Each contact assembly may include one or more electrical conductors. The non-recoiling contact assembly may float in its mounting bracket. Part of the mating surface of the recoiling contact assembly may be more elastic than part of the mating surface of the non-recoiling contact assembly. Elastic deformation of the recoiling mating surface by the non-recoiling mating surface may provide a fluid seal for the make-break connection.

24 Claims, 14 Drawing Sheets

Fig. 2C
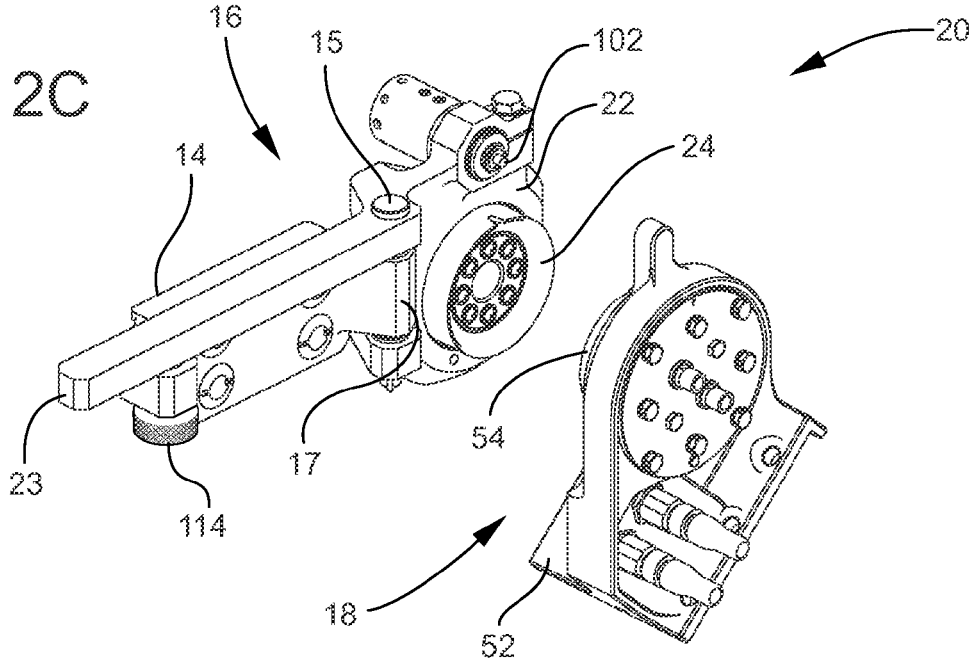
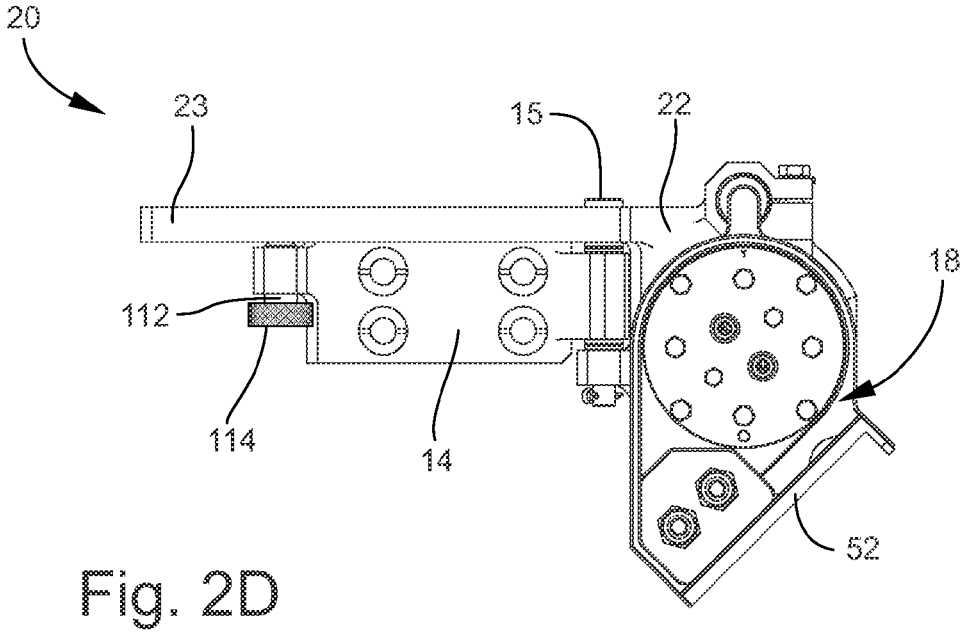
Fig. 2D

FLUID-ISOLATING, SELF-ALIGNING MAKE-BREAK ELECTRICAL CONNECTION

STATEMENT OF GOVERNMENT INTEREST

The inventions described herein may be manufactured, used and licensed by or for the U.S. Government for U.S. Government purposes.

BACKGROUND OF THE INVENTION

The invention relates in general to make-break electrical connections and in particular to make-break electrical connections that may be suitable for recoiling systems.

The problem of electrical system integration on recoiling systems has existed at least since laser ignition for cannons was shown to be a viable alternative to percussion primer caps. Previous means of electrical power and/or electrical signal transfer have not been satisfactory. In past experiments for the integration of laser ignition systems, a continuous cable design was utilized to transfer electrical power and/or electrical signals across recoiling and non-recoiling portions of cannons. Standard electro-mechanical make-break connections, such as pin and socket designs, have also been used in the past on weapons systems.

The known electro-mechanical make-break connections were not able to meet all necessary design conditions for fire on non-contained cannons. Some self-aligning designs were unacceptable for use on cannons because the self-aligning pin and socket proved to be flawed under heavy firing conditions. For example, during the recoil alignment, pin vibrations were transferred to the non-recoiling components via the sockets and subsequently damaged the make-break connection. Such damage demonstrated the need for a new way to successfully align the mating halves.

Additionally, the prior art make-break connections were not viable for exterior use because they were not able to be isolated from fluid penetration. Furthermore, make-break connections such as the pin and socket contact design were prone to particle/fluid collection in exterior settings.

The continuous cable temporary concept used in preliminary testing of breech-mounted laser ignition systems also proved to be unsatisfactory. The cable could not perform over the threshold life-cycle requirements set for the make-break connection and was prone to entanglements on the weapon during fire.

A need exists for a fluid-isolating electrical power/signal make-break connection for recoil systems.

SUMMARY OF THE INVENTION

It is an object of the invention to provide a fluid-isolating electrical power/signal make-break connection for a recoil system.

One aspect of the invention is an electrical make-break connection for an apparatus having a recoiling portion and a non-recoiling portion. The connection may include a non-recoiling assembly fixed to the non-recoiling portion and a recoiling assembly fixed to the recoiling portion.

The non-recoiling assembly may include a mounting bracket and a contact assembly removably disposed in the mounting bracket. The contact assembly may include a housing with a generally conically-shaped female portion on a mating side thereof, a radially extending flange on an outer surface of the housing, and a tapered slot formed in the generally conically-shaped female portion. The contact assembly may further include at least one wave spring disposed between the mounting bracket and the radially extending flange, and at least one electrical contact pin disposed in the housing and biased outwardly by a spring. The non-recoiling assembly may further include a pair of circumferentially spaced-apart pins fixed to the radially extending flange and partially disposed in the mounting bracket. The pair of pins may have radial and axial clearance in the mounting bracket such that the contact assembly is radially and axially movable with respect to the mounting bracket.

The recoiling assembly may include a mounting bracket and a contact assembly removably disposed in the mounting bracket. The contact assembly may include a housing with a generally conically-shaped male portion on a mating side thereof for engaging and disengaging with the generally conically-shaped female portion of the housing of the non-recoiling assembly, and a boss formed on the generally conically-shaped male portion for mating with the tapered slot. The contact assembly may further include at least one electrical contact disposed in the housing and operable to mate with the at least one electrical contact pin of the non-recoiling assembly.

The contact assembly of the recoiling portion may include a face seal disposed on the mating side thereof. The at least one electrical contact may extend through the face seal. The face seal may be made of an electrically insulating material and the non-recoiling contact assembly housing may be made of an electrically conductive material. The material of the face seal may be more compliant than the material of the non-recoiling contact assembly housing.

The non-recoiling contact assembly housing may include a raised ridge disposed radially inward of the generally conically-shaped female portion. The raised ridge may surround the at least one electrical contact pin. The raised ridge may elastically deform the face seal when the non-recoiling assembly and the recoiling assembly are in a connected state.

The non-recoiling contact assembly may include an electrically insulating pin housing disposed around the at least one electrical contact pin. The pin housing may include a ridge portion that surrounds the at least one electrical contact pin and protrudes outwardly with respect to an adjacent surface of the non-recoiling contact assembly housing. The ridge portion may elastically deform the face seal when the non-recoiling assembly and the recoiling assembly are in a connected state.

The at least one wave spring may bias the non-recoiling contact assembly housing toward the recoiling contact assembly. The mounting bracket of the non-recoiling assembly may be rotatably fixed to the non-recoiling portion of the apparatus. The non-recoiling portion may include a hinge for rotatably mounting the non-recoiling mounting bracket. The non-recoiling assembly may include a spring-loaded plunger for preventing rotation of the non-recoiling mounting bracket.

When the non-recoiling assembly and the recoiling assembly are in a connected state, rotation of the non-recoiling mounting bracket may cause the non-recoiling contact assembly to move away from the recoiling contact assembly. The contact assembly of the recoiling portion may include a contact module adjacent the face seal, a cup adjacent the contact module, and a retaining pin that extends through the cup, the contact module and the face seal.

The non-recoiling assembly may include an electrical contact switch and the recoiling assembly may include a corresponding contact switch surface. The contact switch may close when the non-recoiling assembly and the recoiling assembly are in a connected state.

The non-recoiling portion of the apparatus may include a first isolator bracket having the hinge fixed thereto, a second isolator bracket rigidly fixed to the non-recoiling portion of the apparatus, at least one adjustor in threaded engagement with the first isolator bracket, and at least one fastener that rigidly fixes the first isolator bracket to the second isolator bracket.

A gap between the first isolator bracket and the second isolator bracket, along a recoil axis of the apparatus, may be adjustable by threading the at least one adjustor. Ends of the at least one adjustor may include generally convex spherical surfaces. The connection may further include washers disposed at the ends of the at least one adjustor. The washers may have concave spherical surfaces for mating with the convex spherical surfaces of the at least one adjustor. The at least one adjustor and the washers may include central bores for receiving the at least one fastener that rigidly fixes the first isolator bracket to the second isolator bracket.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

FIG. 1A shows the apparatus in a non-recoil or connected state and FIG. 1B shows the apparatus in a recoil or unconnected state.

FIGS. 2A, 2B, and 2C are perspective views and FIGS. 2D, 2E, 2F, and 2G are rear, top, left side, and right side views, respectively, of one embodiment of an electrical make-break connection in an unconnected state (out of battery).

DETAILED DESCRIPTION OF THE PREFERRED EMBODIMENTS

Figure 1B:
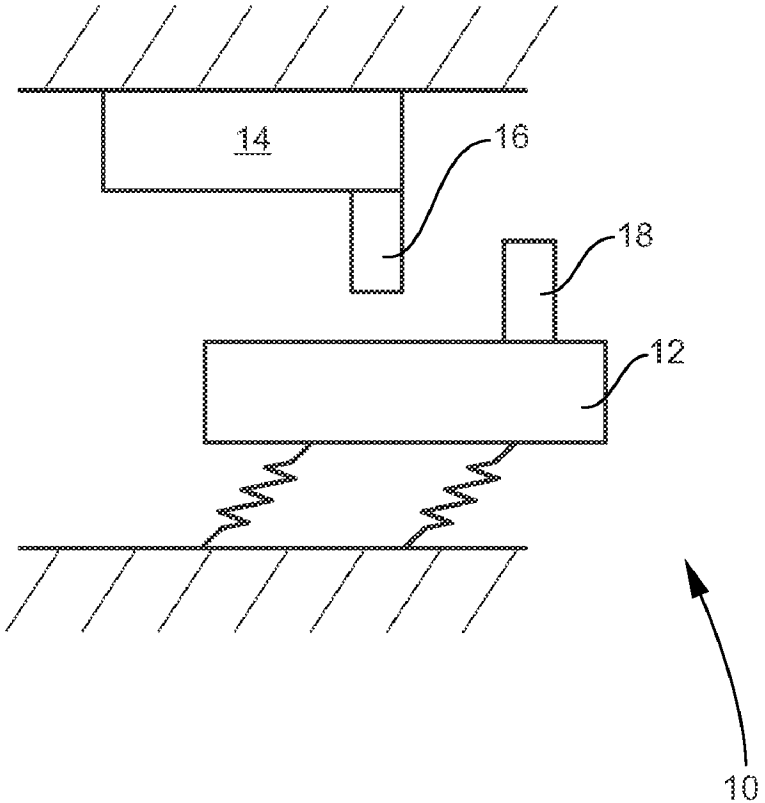
FIGS. 1A and 1B are schematic drawings of an apparatus having a recoiling portion and a non-recoiling portion.
Figure 1A:
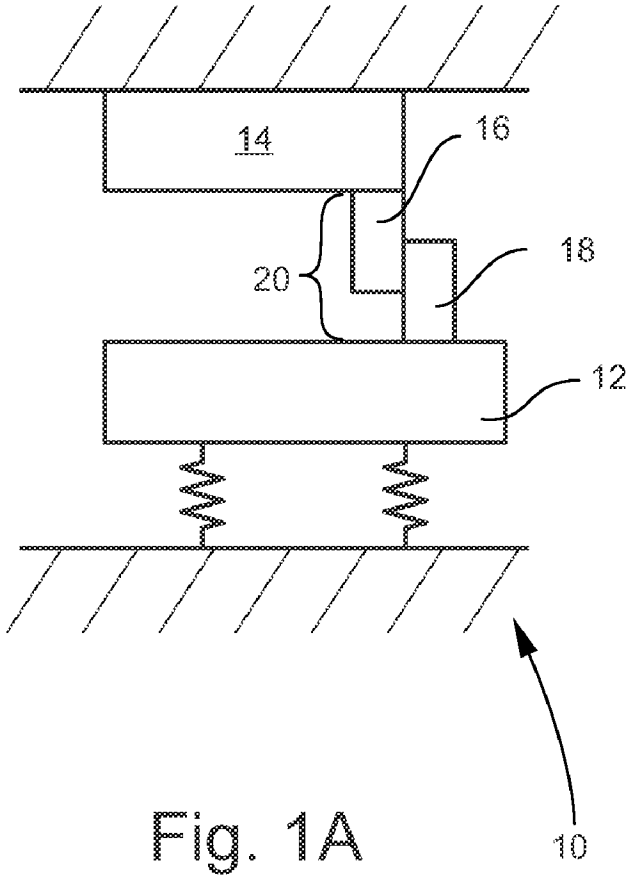

FIGS. 1A and 1B are schematic drawings of an apparatus 10 having a recoiling portion 12 and a non-recoiling portion 14. FIG. 1A shows apparatus 10 in a non-recoil or connected state and FIG. 1B shows apparatus 10 in a recoil or unconnected state. Recoiling portion 12 may include a recoiling assembly 18 and non-recoiling portion 14 may include a non-recoiling assembly 16. An electrical make-break connection 20 may include recoiling assembly 18 and non-recoiling assembly 16.

Recoiling portion 12 is shown in FIGS. 1A-B as spring-supported, however, other means may be used to support recoiling portion 12. For example, apparatus 10 may be a cannon and recoiling portion 12 may be a recoiling portion of the cannon, which may be supported by known methods (other than springs) that are used to support the recoiling portion of a cannon.

A fluid-isolating make-break connection 20 may allow apparatus 10 to repeatedly form and reform an electrical circuit. In one embodiment, apparatus 10 may be a cannon and connection 20 may allow the cannon to form and reform an electrical circuit as the cannon recoils and then returns to battery. Make-break connection 20 may allow electrical signal and power transfer between recoiling and non-recoiling portions 12, 14 used in outdoor environments. Make-break connection 20 may function effectively even though the recoiling and non-recoiling portions 12, 14 may be misaligned. For example, if apparatus 10 is a cannon, the recoiling and non-recoiling portions 12, 14 may be misaligned when the cannon returns to battery.

Make-break connection 20 may withstand high-G (acceleration) and high-shock loading. Make-break connection 20 may not allow fluid penetration into connection 20. Make-break connection 20 may be maintained and/or cleaned while apparatus 10 is in a non-recoil state (FIG. 1A). Make-break connection 20 may be more reliable than the current primer feed mechanism that may be used with a cannon.

Make-break connection 20 may enable electrical power and electrical signal transmission across a gun that produces significant recoil (both force and displacement) in a non-compartmentalized environment. So, make-break connection 20 may enable the operation of cannon systems (particularly those that are not insulated from the elements) having laser ignition. Make-break connection 20 may enable other recoiling devices (not limited to laser-ignition systems) to operate and/or communicate.

Several aspects of make-break connection 20 may be advantageous, compared to prior art make-break connections. One advantageous aspect may be a unique self-alignment mechanism. The self-alignment component of prior make-break connections was based upon a pin and socket design. Known make-break connections could realign upon returning to battery, within a certain amount of bi-axial displacement. The sockets in the known connections were countersunk to allow for the bi-axial displacement and to guide the pins back to their mated position. Testing of the pin and socket design showed that recoil vibrations during firing caused the pins to damage the known make-break connection.

Make-break connection 20 may be self-aligning and may use a "floating" housing design. In some embodiments of make-break connection 20, a non-recoiling housing may be nested within a non-recoiling bracket to allow for bi-axial displacement, for example, about 1/16 inch bi-axial displacement. A recoiling housing and a non-recoiling housing may include male and female mating conical sections. The male and female conical sections may guide connection 20 back to its connected position. Connection 20 may not be susceptible to recoiling forces while firing, in contrast to known connections.

Additionally, connection 20 may form a fluid barrier. The fluid barrier may isolate make-break connection 20 from fluid penetration, unlike known connections. Fluid isolation may enable use of make-break connection 20 in settings such as exterior settings (open to the elements) and for deep-water fording. Make-break connection 20 may include numerous and redundant seals to provide such a fluid barrier. The seals may include a face seal, O-rings fitted to housing covers and contact modules, and cap seals within the contact modules themselves. The combination of the seals may effectively fluidly isolate the electrical system of make-break connection 20.

Make-break connection 20 may prevent fluid/particle collection. Contact pins of make-break connection 20 may protrude from the non-recoiling surface. The contact pins may be spring-loaded and may depress back into their cavities upon mating. The protruding and depressible nature of the contact pins may not allow a surface for any fluid and/or particle(s) to collect while make-break connection 20 is separated. Unlike current pin and socket designs, electrical contacts of make-break connection 20 may be spaced apart and/or encapsulated by an insulator to mitigate cross-short circuits.

Another advantage of make-break connection 20 may be the ability to be cleaned and maintenanced while the apparatus 10 is in the non-recoil state (FIG. 1A). A pivot-hinge component may be included in make-break connection 20 to allow non-recoiling assembly 16 to open, thereby permitting access to the contact modules and any other mating surfaces. Known make-break connections may have to be uninstalled from their mounts to gain such access for maintenance and/or cleaning.

Make-break connection 20 may include a modular design so that damage/wear may be compartmentalized and may not compromise the entire system. Contact assemblies of make-break connection 20 may be replaced without having to uninstall and/or replace the entire system. Recoiling and non-recoiling mounting brackets may house the contact assemblies that experience the wear and degradation that come with repeated use. The contact assemblies may be replaced in the event of damage and/or excessive wear. The contact assemblies may be easily removed from each respective mounting bracket by removing the contact assembly cover. The ease of replacement of the contact assemblies may reduce logistical burden and cost(s) over the life of the system.

Figure 2A:
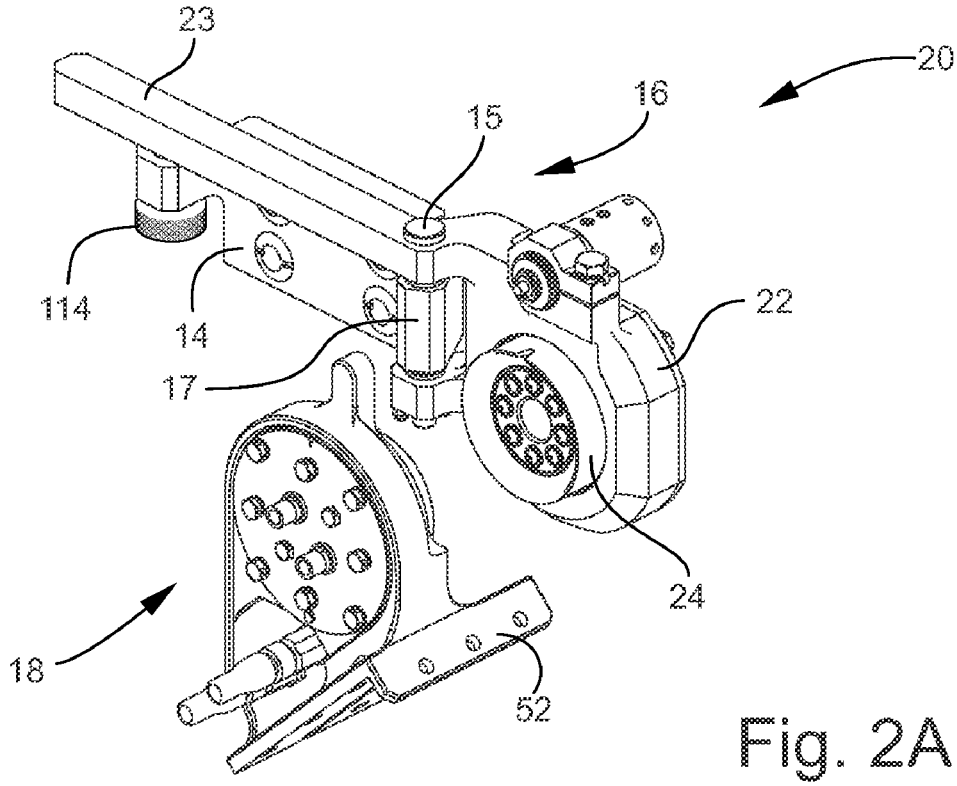
Figure 2B:
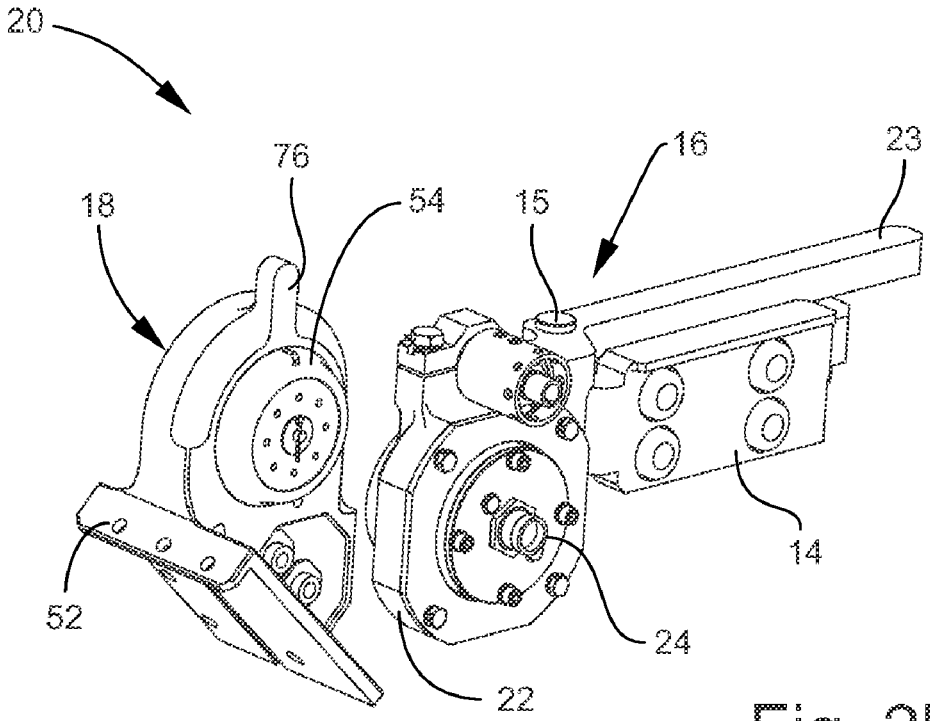
Figure 2E:
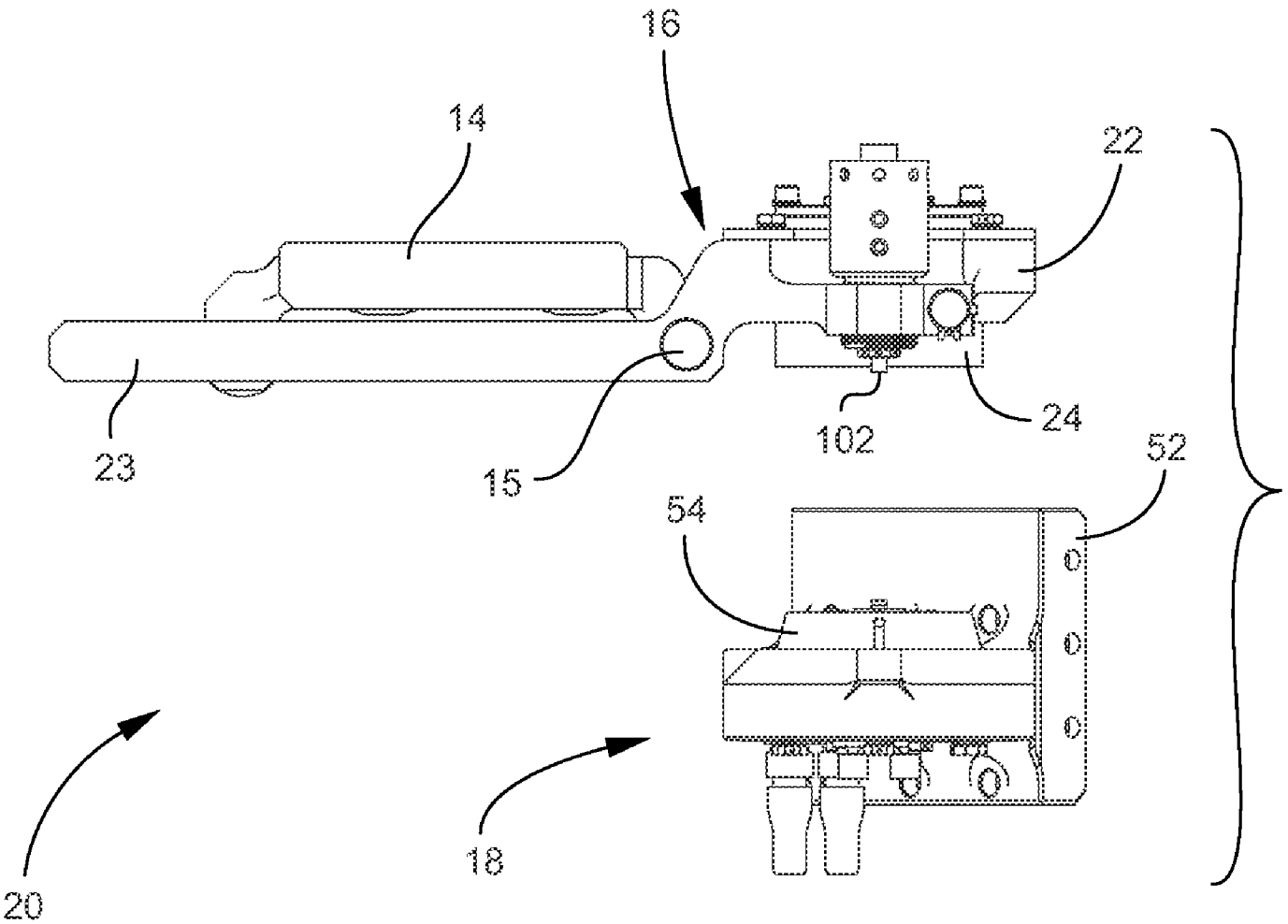
Figure 2F:
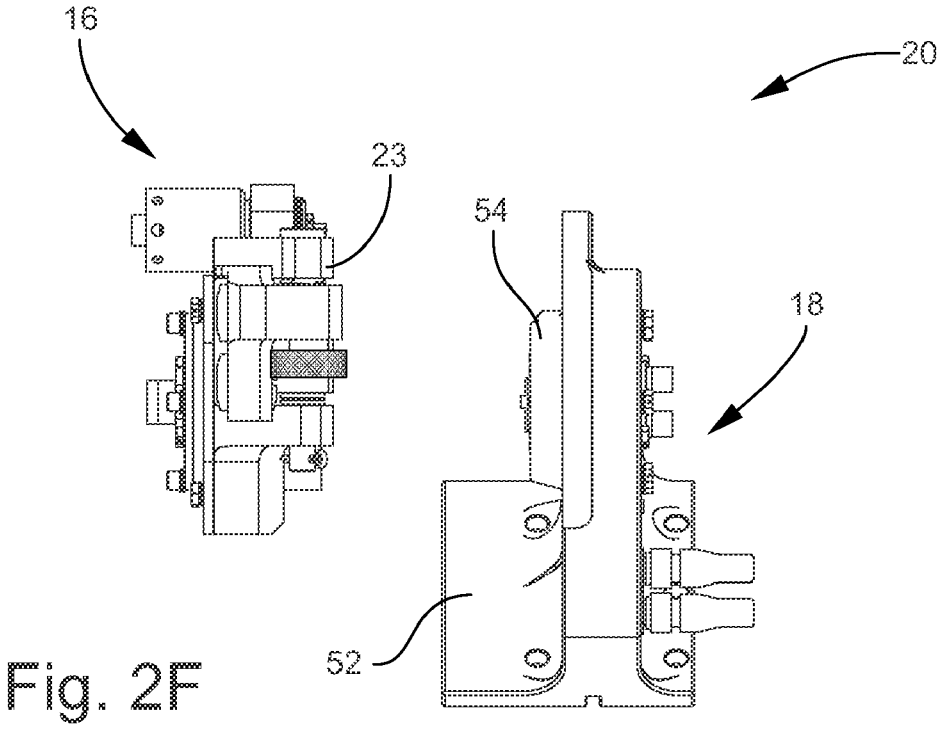
Figure 2G:
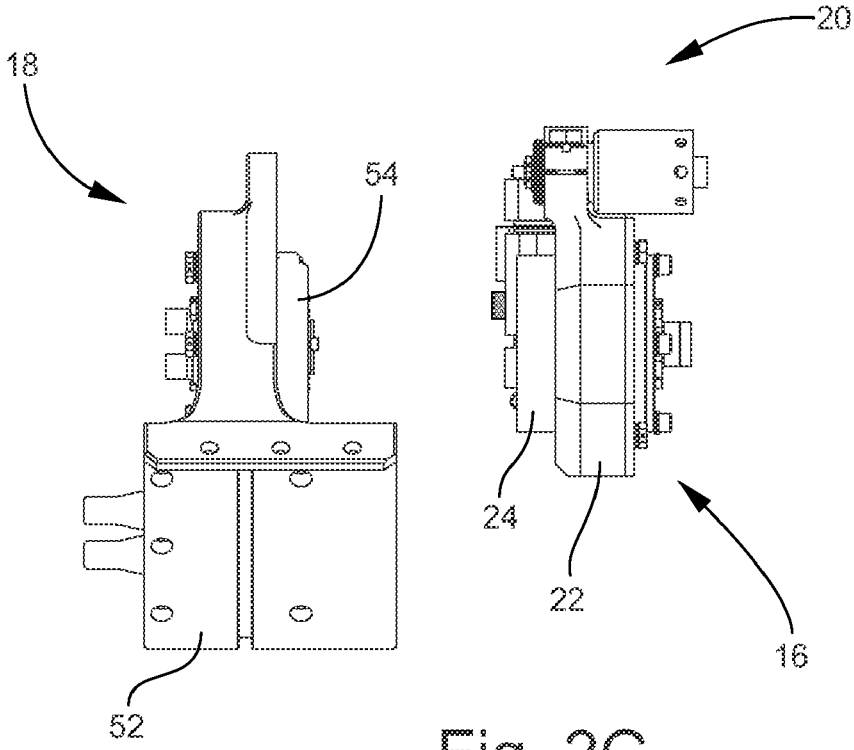
Figure 3A:
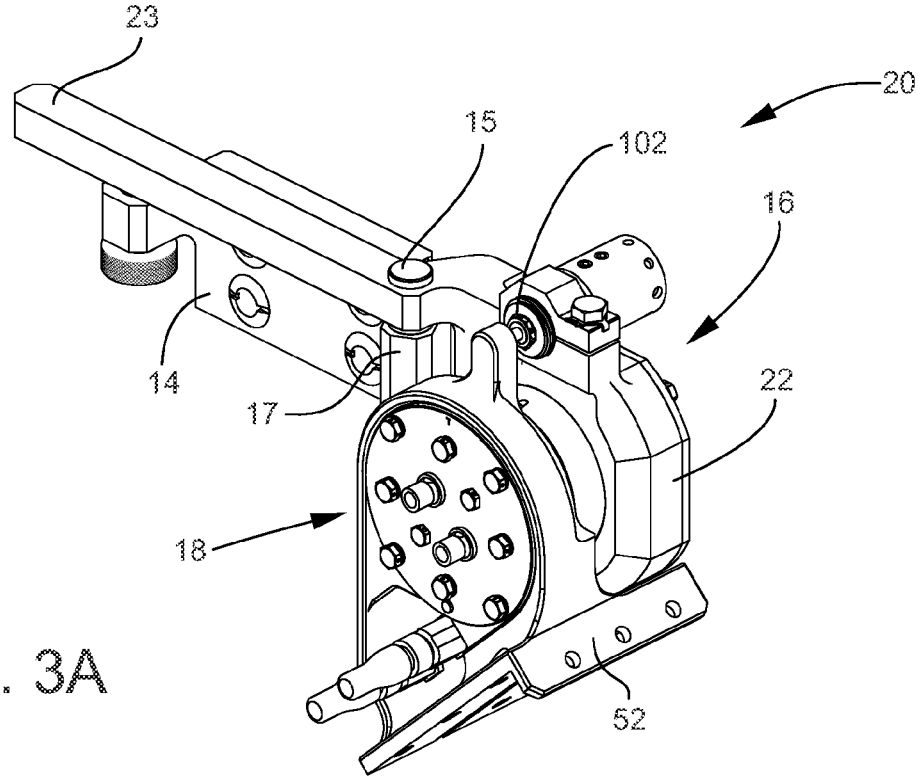
FIGS. 3A-G are views corresponding to FIGS. 2A-G, showing the electrical make-break connection in a connected state (in battery).
Figure 3B:
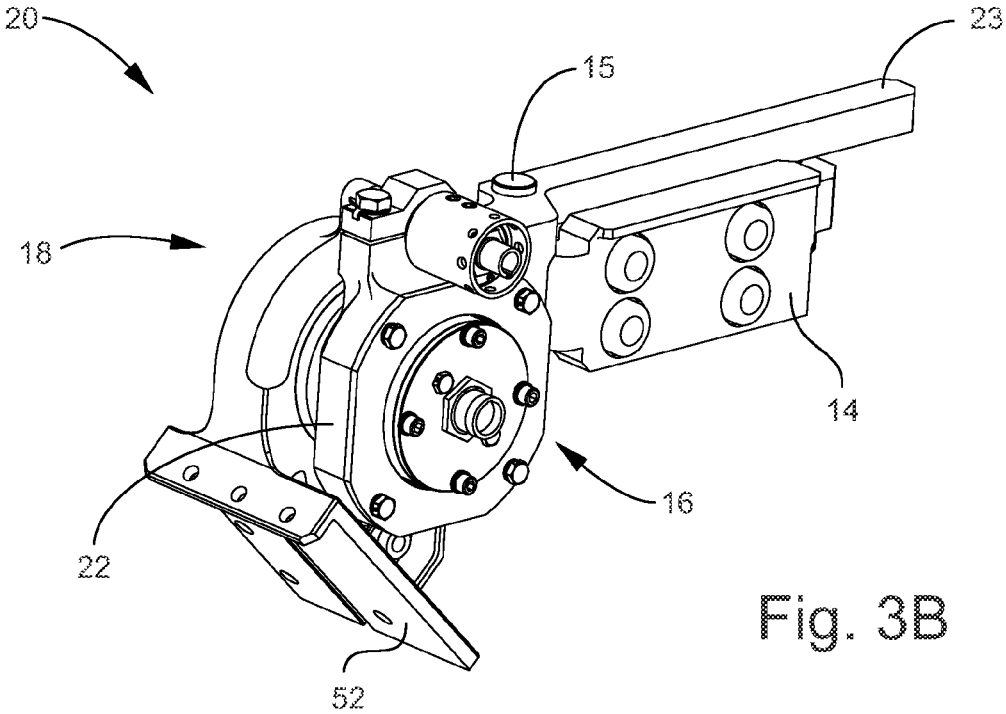
Figure 3C:
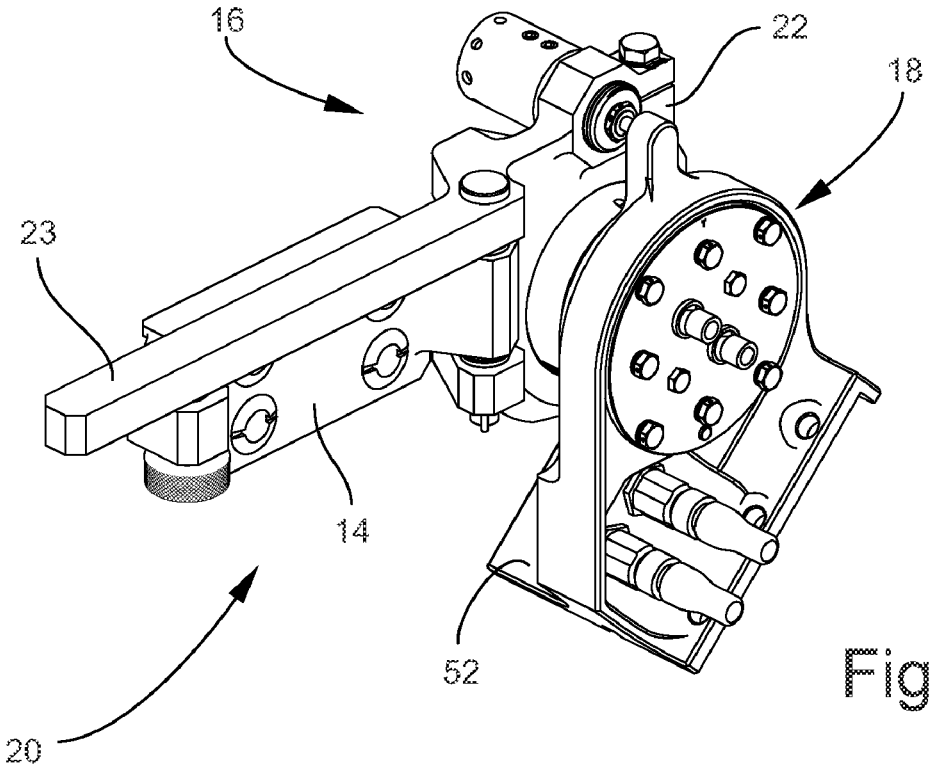
Figure 3D:
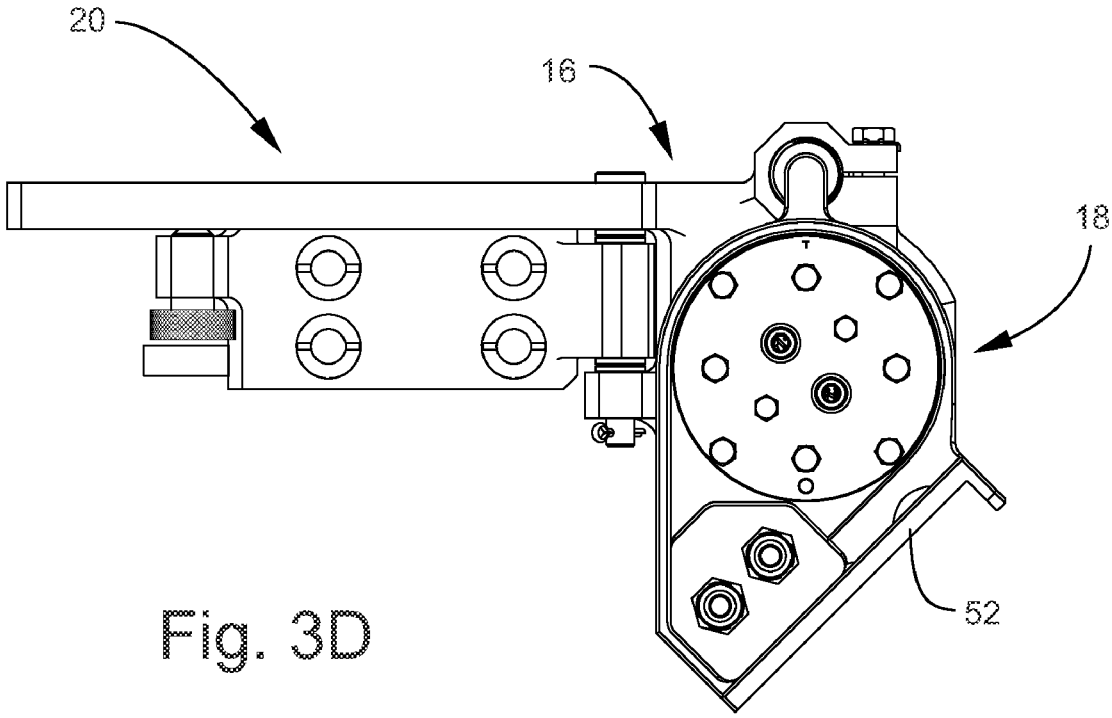
Figure 3E:
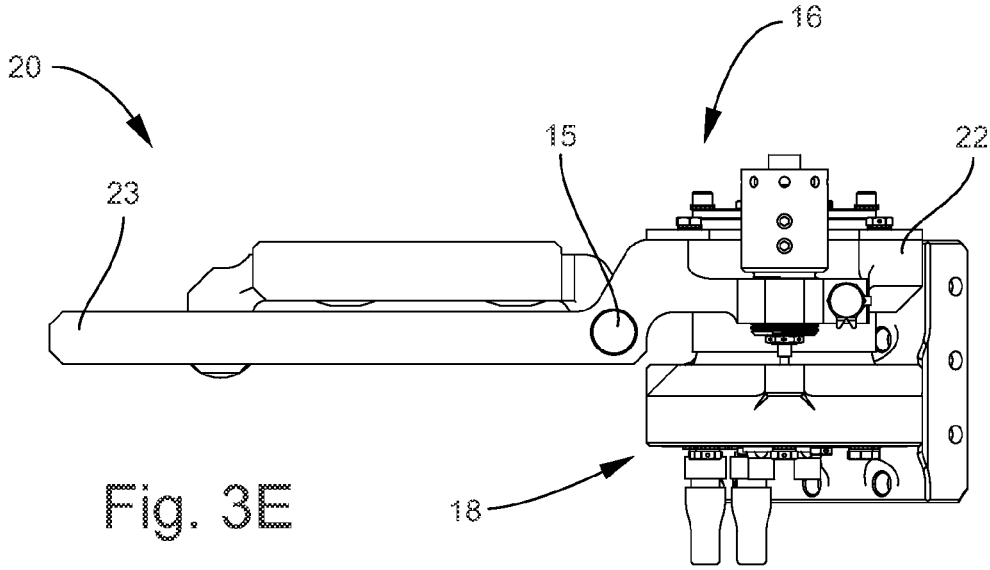
Figure 3F:
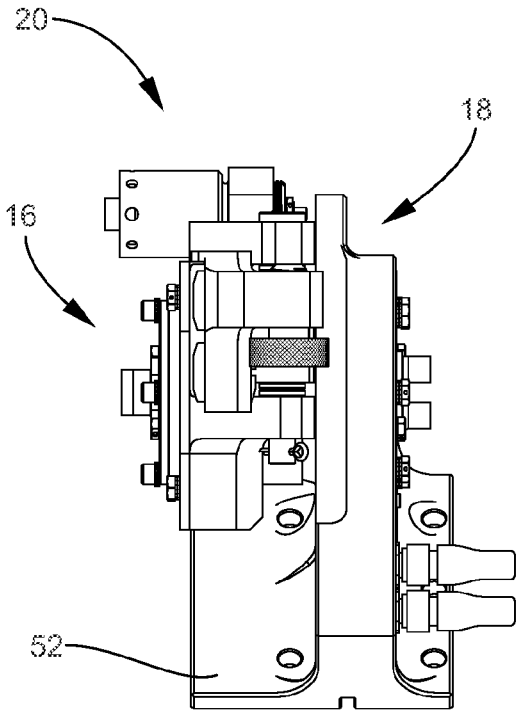
Figure 3G:
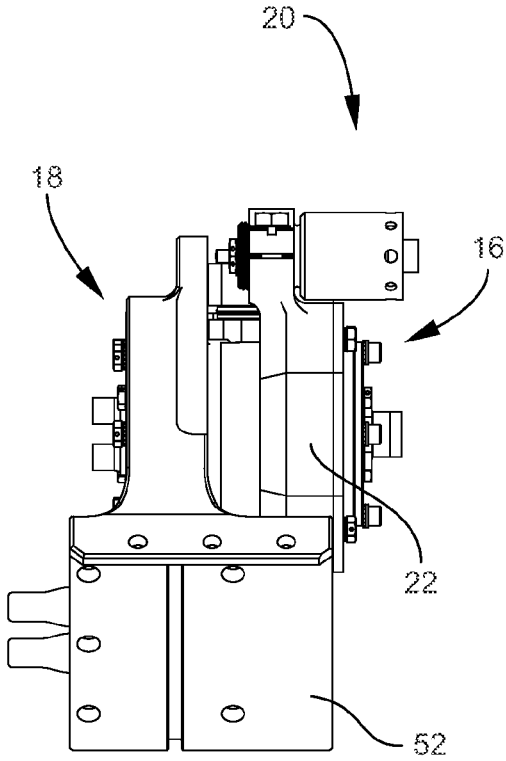

FIGS. 2A, 2B, and 2C are perspective views and FIGS. 2D, 2E, 2F, and 2G are rear, top, left side, and right side views, respectively, of one embodiment of electrical make-break connection 20 in an unconnected state (out of battery). FIGS. 3A-G are views corresponding to FIGS. 2A-G, showing electrical make-break connection 20 in a connected state (in battery).

Make-break connection 20 may include a non-recoiling assembly 16 fixed to non-recoiling portion 14 and a recoiling assembly 18 fixed to recoiling portion 12 (FIGS. 1A-B). Non-recoiling assembly 16 may be fixed to non-recoiling portion 14 with a mounting bracket 22. Mounting bracket 22 may be hinged to non-recoiling portion 14 via a hinge pin 15 and hinge 17. Mounting bracket 22 may include an arm 23 for pivoting or rotating bracket 22. Recoiling assembly 18 may be fixed to recoiling portion 12 with a mounting bracket 52.

Figure 4C:
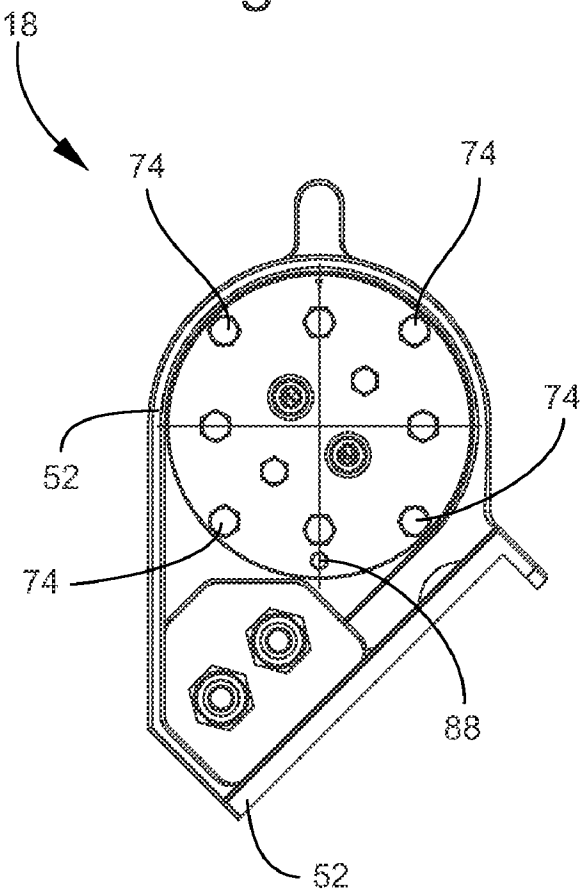
FIGS. 4A-C are front, side, and rear views, respectively, of the recoiling assembly of the make-break connection in FIGS. 2 and 3.
Figure 4B:
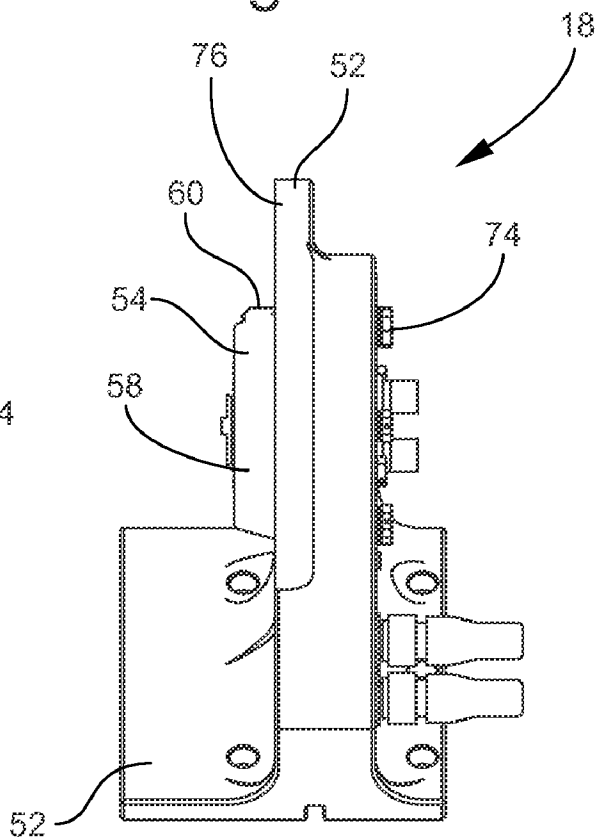
Figure 4A:
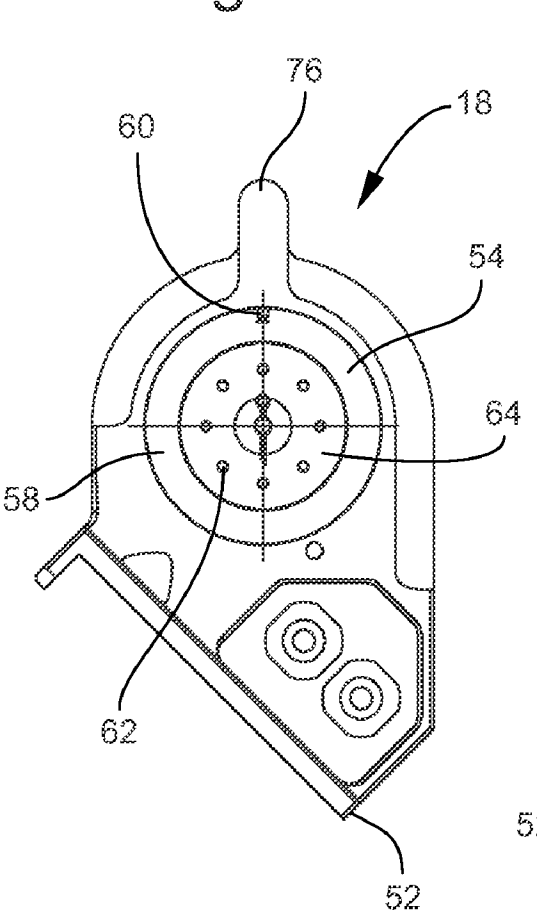

FIGS. 4A-C are front, side, and rear views, respectively, of recoiling assembly 18. Recoiling assembly 18 may include a contact assembly 54 removably disposed in mounting bracket 52. Contact assembly 54 may be removed from mounting bracket 52 by, for example, removing four fasteners 74. Mounting bracket 52 may include a contact surface 76. Contact surface 76 may project or protrude from the rest of bracket 52.

Figure 5B:
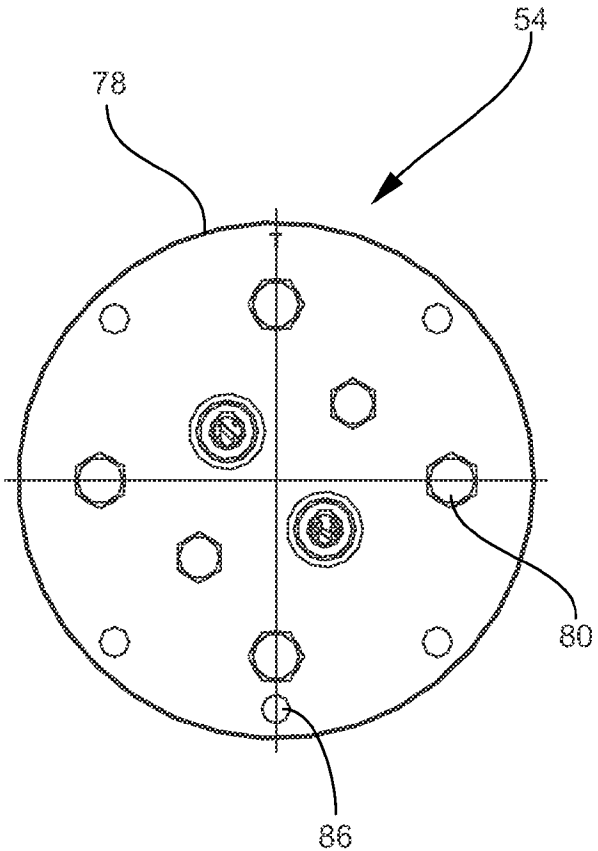
FIGS. 5A and 5B are front and rear views, respectively, of the contact assembly of the recoiling assembly in FIGS. 4A-C.
Figure 5C:
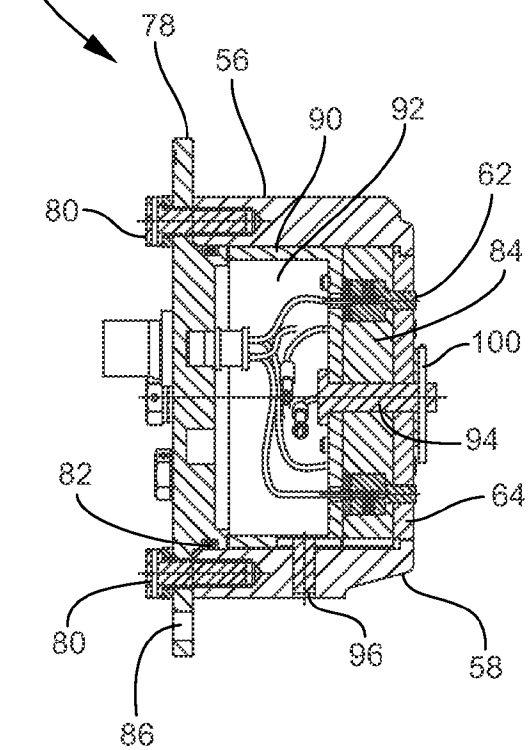
FIG. 5C is a sectional view along the line 5C-5C of FIG. 5A.
Figure 5A:
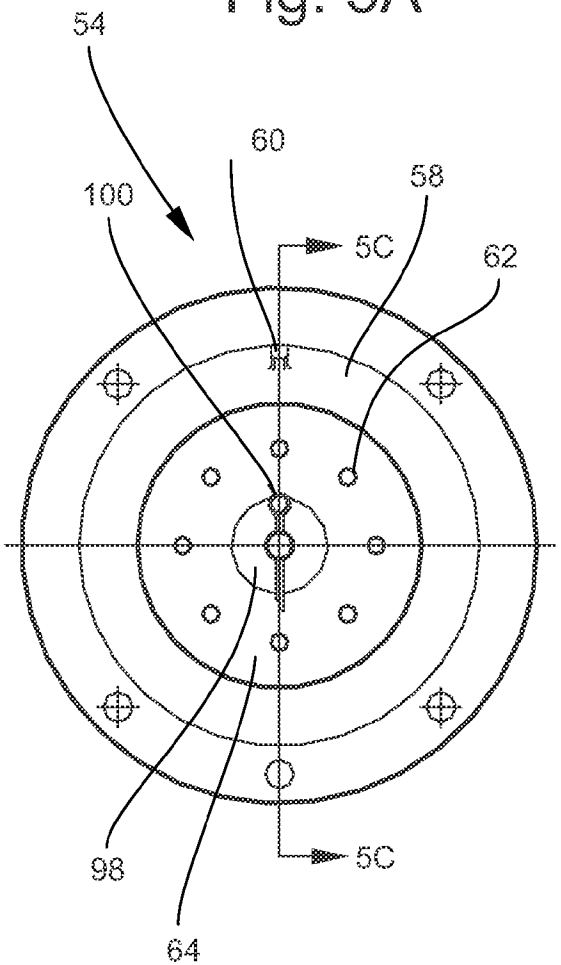

FIGS. 5A and 5B are front and rear views, respectively, of contact assembly 54, and FIG. 5C is a sectional view along the line 5C-5C of FIG. 5A. Contact assembly 54 may include a housing 56 with a generally conically-shaped male portion 58 on a front side thereof. A boss 60 may be formed on generally conically-shaped male portion 58. At least one electrical contact 62 (eight contacts 62 are shown in the Figs.) may be disposed in housing 56. A face seal 64 may be disposed on the front side of contact assembly 54. Electrical contacts 62 may extend through face seal 64. Face seal 64 may be made of an elastomeric, electrically insulating material. A cover 78 may be fixed to housing 56 with, for example, fasteners 80. A seal between cover 78 and housing 56 may be provided by, for example, O-ring 82. Cover 78 may include an opening 86 for receiving an alignment pin 88 (FIG. 4C). Pin 88 may ensure proper circumferential orientation of contact assembly 54.

Referring to FIG. 5C, a contact module 84 containing contacts 62 may be disposed adjacent face seal 64. Adjacent module 84 may be a cup 90 containing potting compound 92. Cup 90 may be aligned with housing 56 using alignment pin 96. A retaining pin 94 may extend through cup 90, contact module 84 and face seal 64 to fix the position of contact module 84 and face seal 64. A washer 98 and cotter pin 100 may used to secure retaining pin 94. In case of damage to face seal 64, fasteners 80 and cover plate 78 may be removed and then cup 90, contact module 84 and face seal 64 may be removed from housing 56. Face seal 64 may then be replaced by removing cotter pin 100 and washer 98.

Figure 6A:
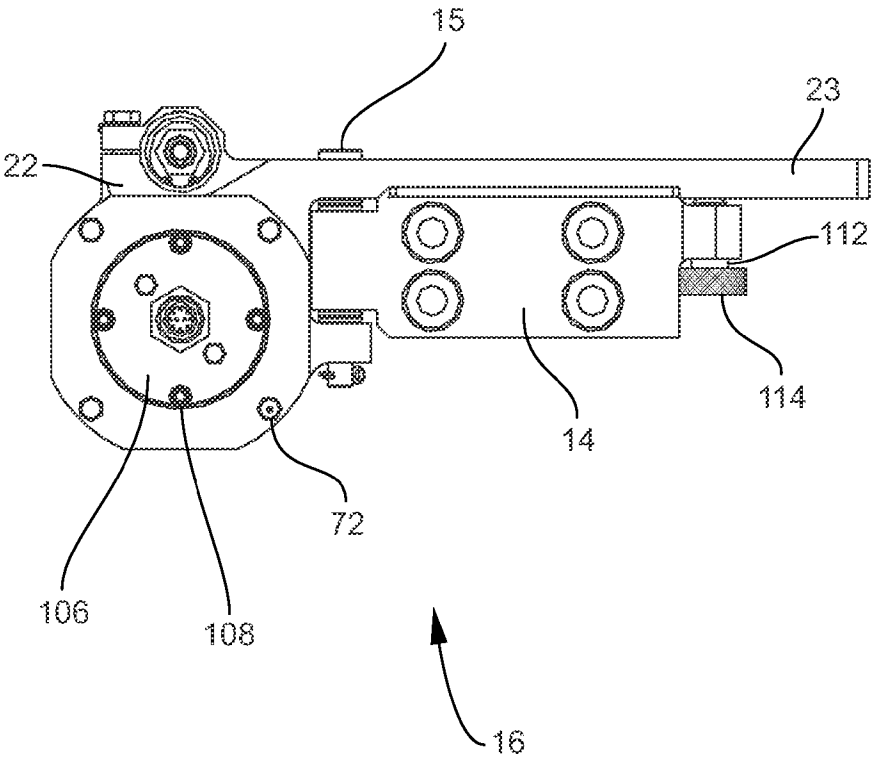
FIGS. 6A and 6B are front and rear views, respectively, of the non-recoiling assembly of the make break connection in FIGS. 2 and 3.
Figure 6B:
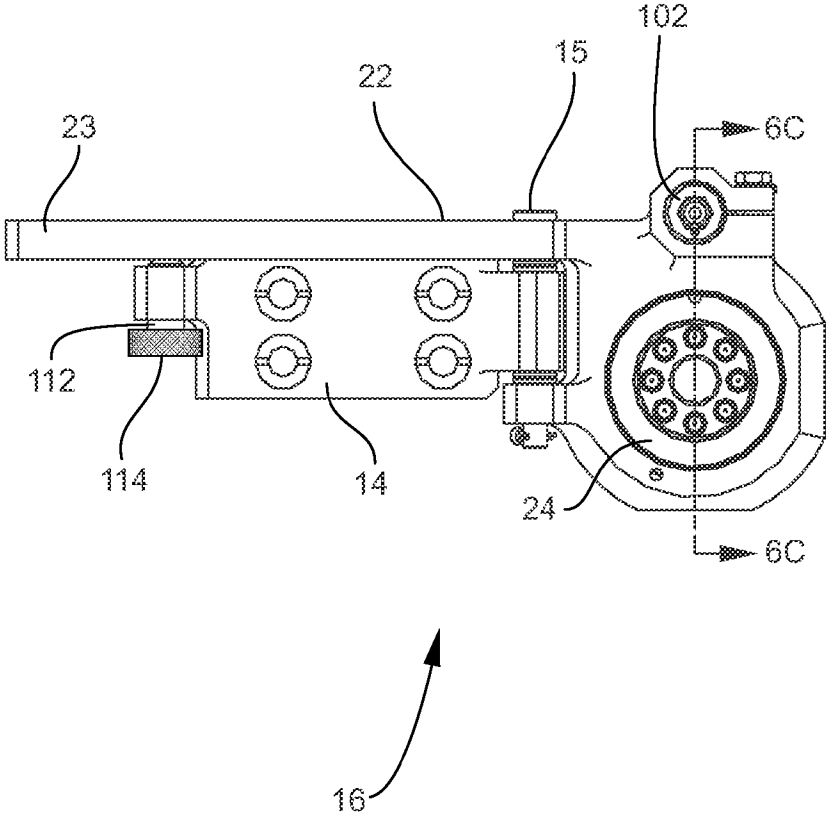
Figure 6C:
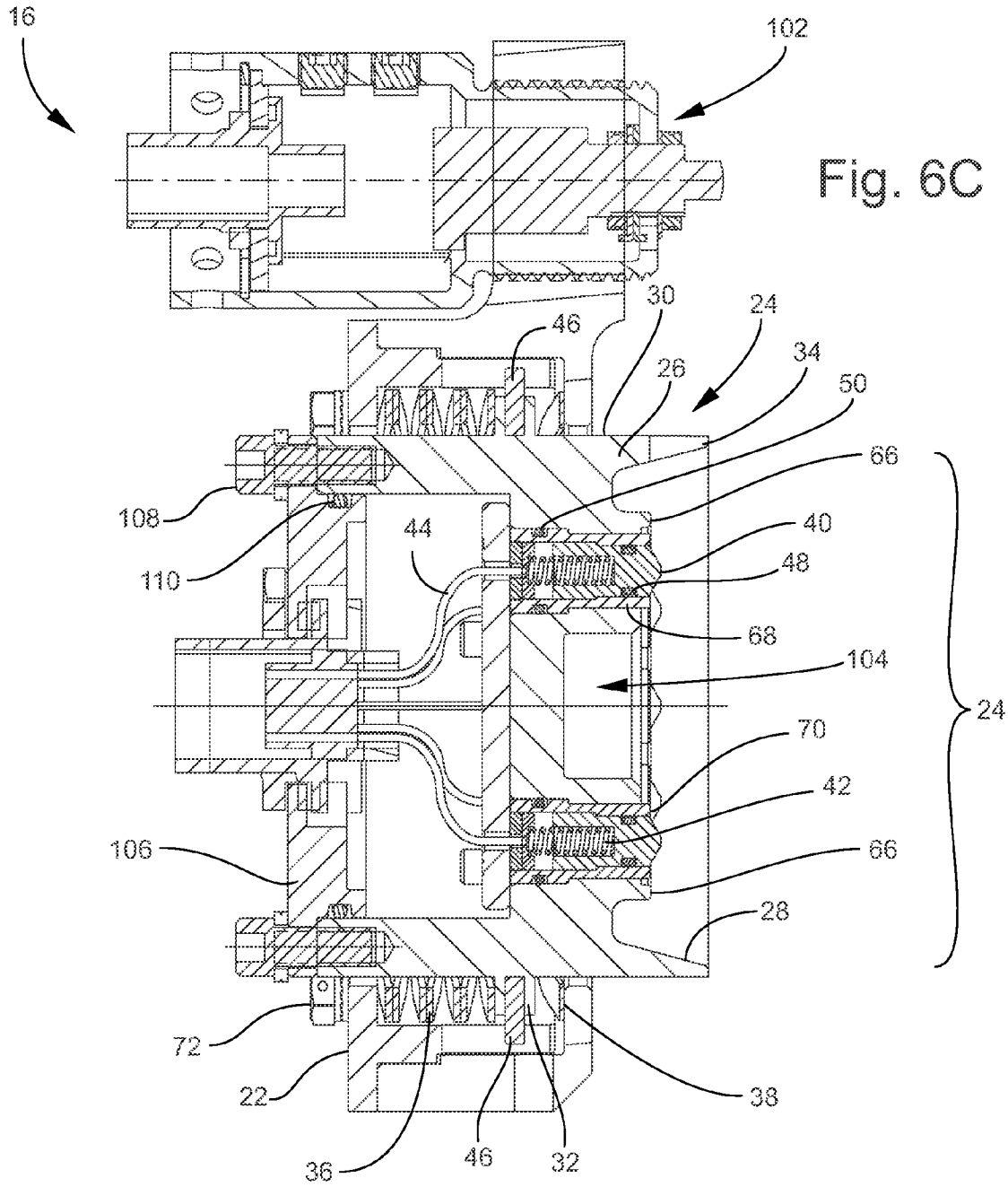
FIG. 6C is an enlarged sectional view along the line 6C-6C of FIG. 6B.

FIGS. 6A and 613 are front and rear views, respectively, of non-recoiling assembly 16. FIG. 6C is an enlarged sectional view along the line 6C-6C of FIG. 6B. Non-recoiling assembly 16 may include a contact assembly 24 removably disposed in mounting bracket 22. Contact assembly 24 may be removed from mounting bracket 22 by, for example, removing four fasteners 72.

Non-recoiling assembly 16 may include a contact switch 102. When make-break connection 20 is in a connected state (in battery), contact switch 102 may be closed by contact with contact surface 76 (FIG. 4A) of recoiling assembly 18. When make-break connection 20 is in an unconnected state (out of battery), contact switch 102 may be open and not in contact with contact surface 76 of recoiling assembly 18. The transmission of electrical power and/or data from non-recoiling assembly 16 to recoiling assembly 18 may be selectively controlled by contact switch 102. That is, only when contact switch 102 is closed may electric power and/or data be transferred from non-recoiling assembly 16 to recoiling assembly 18.

Referring to FIG. 6C, contact assembly 24 may include a housing 26 with a generally conically-shaped female portion 28 on a mating side thereof. Conically-shaped female portion 28 may mate with conically-shaped male portion 58 (FIGS. 4-5) of contact assembly 54. A tapered slot 34 may be formed in conically-shaped female portion 28. Tapered slot 34 may function as a guide for boss 60 (FIGS. 4-5) on contact assembly 54 when recoiling assembly 18 returns to the connected state (in battery). Contact assembly 24 may include a cover 106 fixed in place with, for example, fasteners 108 and sealed with, for example, an O-ring 110.

Referring to FIG. 6C, contact assembly 24 may be mounted in a "floating" manner in bracket 22. To this end, a radially extending flange 32 may be included on an outer surface 30 of housing 26. Compressive wave springs 36, 38 may be disposed between mounting bracket 22 and opposite sides of radially extending flange 32. Wave springs 36, 38 may provide axial compliance for contact assembly 24. Wave springs 36, 38 may bias contact assembly 24 towards contact assembly 54. As viewed in FIG. 6C, wave springs 36, 38 may bias contact assembly 24 to the right.

Circumferentially spaced-apart alignment pins 46 may be fixed in flange 32. Alignment pins 46 may be partially disposed in mounting bracket 22. Mounting bracket 22 may include radial and axial clearance for pins 46 such that contact assembly 24 may be radially and axially movable with respect to mounting bracket 22. Thus, contact assembly 24 may "float" in mounting bracket 22.

At least one electrical contact pin 40 (eight pins 40 are shown in the Figs.) may be disposed in housing 26. Pins 40 may be biased outwardly by, for example, springs 42. At least one electrical conductor 44 may be disposed in housing 26 and may be electrically connected to at least one contact pin 40. Pins 40 may be operable to contact electrical contacts 62 of contact assembly 54 (FIGS. 4-5) when make-break connection 20 is in a connected state (in battery). Housing 26 may include a central opening 104 for receiving an end of retaining pin 94, washer 98 and cotter pin 100, which are located on the mating face of contact assembly 54 (FIG. 5C).

Housing 26 may be made of an electrically conductive material, such as, for example, steel. The material of composition of face seal 64 (FIG. 5C) may be more compliant (elastic) than the material of composition of housing 26. Housing 26 may include a raised ridge 66 disposed radially inward of conically-shaped female portion 28. Raised ridge 66 may surround electrical contact pins 40. Raised ridge 66 may elastically deform face seal 64 when non-recoiling assembly 16 and recoiling assembly 18 are in a connected state (in battery), thereby preventing foreign matter from entering the area around electrical contact pins 40 and electrical contacts 62.

Non-recoiling contact assembly 24 may include an electrically insulating pin housing 68 disposed around each electrical contact pin 40. Each pin housing 68 may include a ridge portion 70 that may surround a corresponding contact pin 40. Ridge portion 70 may protrude outwardly with respect to an adjacent surface of non-recoiling contact assembly housing 26. Thus, ridge portion 70 may also elastically deform face seal 64 when non-recoiling assembly 16 and recoiling assembly 18 are in a connected state (in battery), thereby preventing foreign matter from entering the area around electrical contact pin 40 and electrical contact 62.

Fluid sealing around each electrical contact pin 40 may also be provided by a seal 48 (FIG. 6C). Fluid sealing around each pin housing 68 may be provided by a seal 50.

Electrical power may be transferred from non-recoiling assembly 16 to recoiling assembly 18 via electrical contact pins 40 and electrical contacts 62, while recoiling assembly 18 is connected to non-recoiling assembly 16 (in-battery). In embodiments where apparatus 10 is a weapon system, recoiling assembly 18 may be displaced along the fire axis of the gun, thereby severing the electrical connection. Non-recoiling electrical pins 40 may be forced to protrude from contact assembly 24 due to compression spring force of springs 42.

As recoiling assembly 18 returns to battery, non-recoiling contact assembly 24 may couple with recoiling contact assembly 54. Conical female portion 28 of non-recoiling housing 26 may guide conical male portion 58 of recoiling housing 56 to its original position. Recoiling contacts 62 and non-recoiling electrical contact pins 40 may mate as the recoiling housing 56 completes its return. Non-recoiling contact pins 40 may be depressed into their respective cavities and an electrical connection may be reestablished. Wave springs 36, 38 may act upon non-recoiling housing 26 to create a barrier to fluid entry with face seal 64. Individual contacts pins 40 may be further fluidly isolated when raised ridge 66 and protruding ridge portions 70 of pin housings 68 elastically deform face seal 64.

Referring to FIGS. 2 and 3, mounting bracket 22 of non-recoiling assembly 18 may include an arm 23. Arm 23 may be selectively engaged with non-recoiling portion 14 of apparatus 10 by, for example, a spring-loaded plunger 112. A knurled knob 114 on the bottom of plunger 112 may be twisted and pulled down, thereby releasing arm 23. Arm 23 and mounting bracket 22 may then rotate around hinge pin 15. The force generated by wave springs 36, 38 may help to rotate mounting bracket 22 after arm 23 is released by spring-loaded plunger 112.

As mounting bracket 22 rotates, non-recoiling contact assembly 24 may be rotated away from recoiling contact assembly 54, thereby opening the electrical circuit between pins 40 and contacts 62. Recoiling mounting bracket 52 may remain in position. Any necessary cleaning and/or maintenance to the mating surfaces and/or electrical contacts of contact assemblies 24, 54 may be performed while make-break connection 20 is open. Importantly, although make-break connection 20 may be opened by rotating mounting bracket 22, apparatus 10 may still be in the non-recoil position (FIG. 1A).

To close connection 20, arm 23 of mounting bracket 22 may be used to rotate non-recoiling assembly 16 about hinge pin 15 and to overcome the force of wave springs 36, 38. Knurled knob 114 of plunger 112 may be twisted and pulled down, allowing arm 23 and mounting bracket 22 to return to their closed positions. Knob 114 may be released and plunger 112 may enter a hole (not shown) in arm 23, thereby securing make-break connection 20 in its mated or closed position.

The relative location of recoiling assembly 18 and non-recoiling assembly 16 along the axis of recoil of apparatus 10 may be important to ensure that contact assemblies 54, 24 do, in fact, establish an electrical connection in the connected or non-recoil state of FIG. 1A. Additionally, upon returning to the non-recoil state, the recoiling assembly 18 may damage the non-recoiling assembly 16 if the two assemblies 18, 16 are axially located too close to each other. In the past, shims may have been used for positioning and adjustment of make-break connections along the axis of recoil. Shims, however, may provide a step-wise adjustment, rather than a continuous type of adjustment.

Figure 7A:
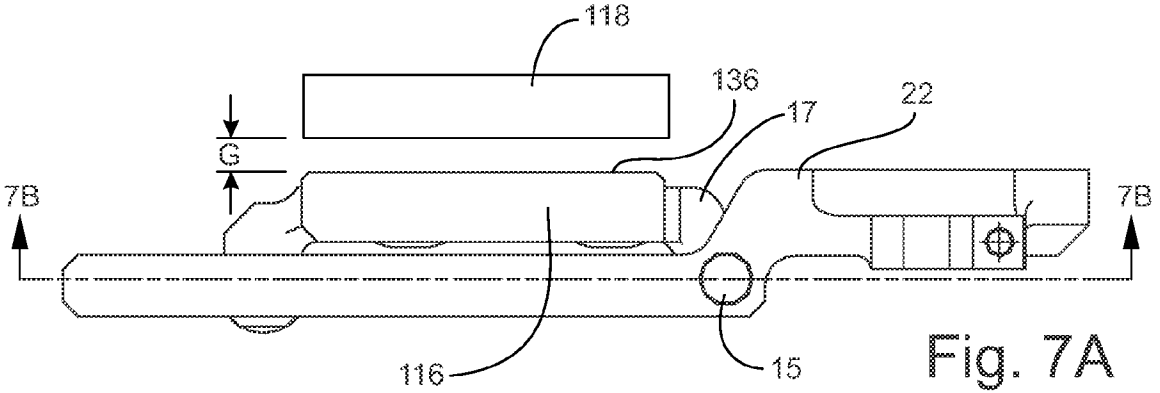
FIG. 7A is a top view of an arrangement for mounting the non-recoiling assembly to the non-recoiling portion of the apparatus.
Figure 7B:
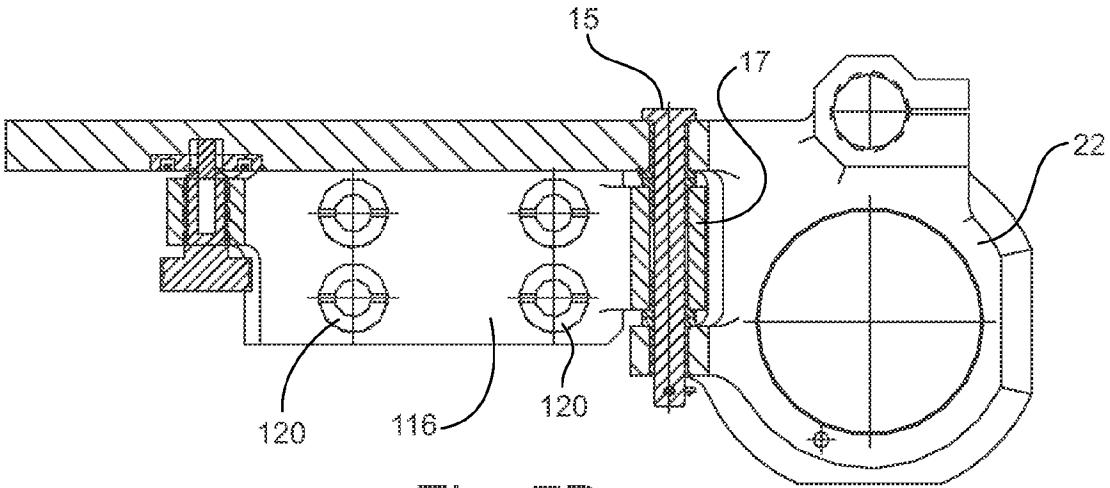
FIG. 7B is a sectional view along the line 7B-7B of FIG. 7A.
Figure 7C:
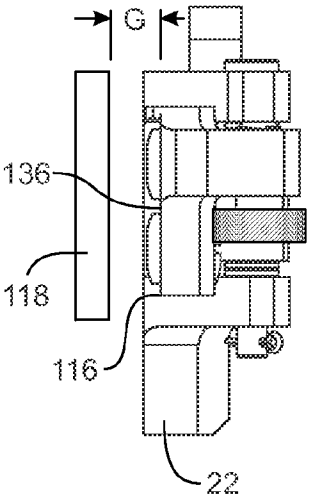
FIG. 7C is an end view of FIG. 7A.

FIG. 7A is a top view of an arrangement for mounting non-recoiling assembly 16 to non-recoiling portion 14 of apparatus 10. FIG. 7B is a sectional view along the line 7B-7B of FIG. 7A. FIG. 7C is an end view of FIG. 7A. Non-recoiling portion 14 of apparatus 10 may include a first isolator bracket 116 having hinge 17 fixed thereto. Non-recoiling mounting bracket 22 may be mounted to hinge 17 with hinge pin 15 (See FIG. 2A also). A second isolator bracket 118 may be rigidly fixed to non-recoiling portion 14 of apparatus 10. At least one adjustor 120 may be in threaded engagement in first isolator bracket 116.

Figure 8A:
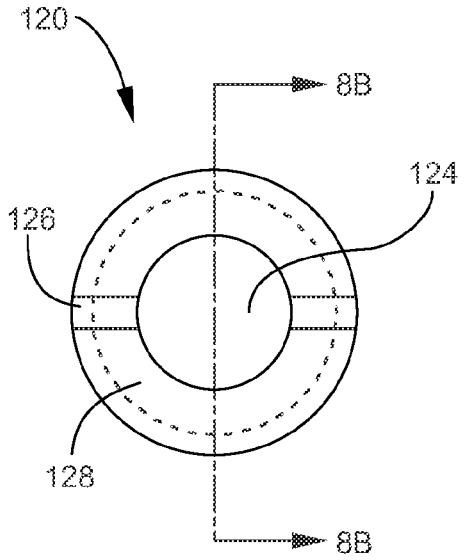
FIG. 8A is a rear view of an adjustor and FIG. 8B is a sectional view along the line 8B-8B of FIG. 8A.
Figure 8B:
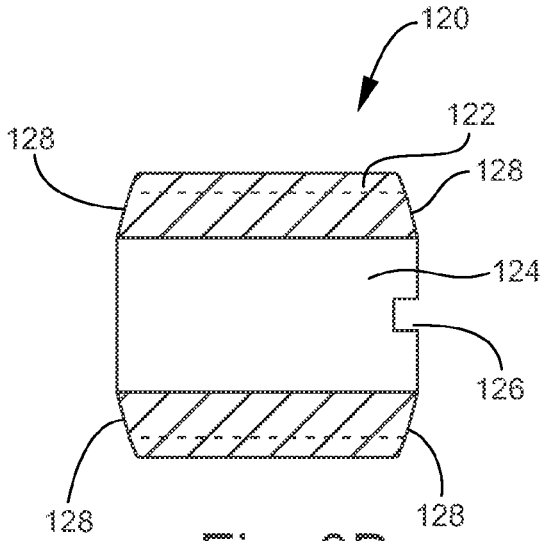
Figure 9A:
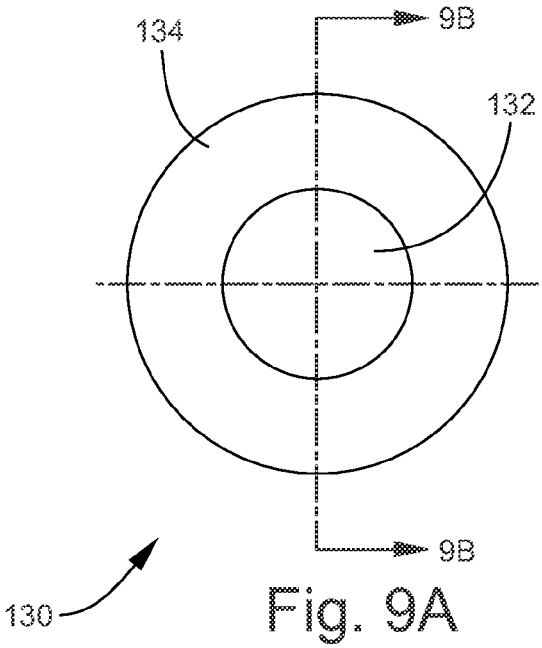
FIG. 9A is a rear view of an adjustor washer and FIG. 9B is a sectional view along the line 9B-9B of FIG. 9A.
Figure 9B:
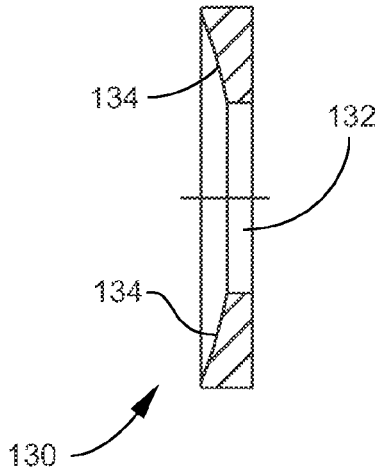

Adjustor 120 (FIGS. 8A-B) may include a threaded portion 122, a central bore 124, a slot 126, and generally spherical surfaces 128 formed on its ends. Spherical surfaces 128 of adjustor 120 may be, for example, convex spherical surfaces. Washers 130 (FIGS. 9A-B) having a central bore 132 and spherical surfaces 134 may be disposed on the ends of adjustor 120. Spherical surfaces 134 of washers 130 may be, for example, concave spherical surfaces. Spherical surfaces 128 of adjustor 120 and spherical surfaces 134 of washers 130 may be substantially contiguous. In FIGS. 7A-C, washers 130 are removed from adjustors 120.

Figure 10:
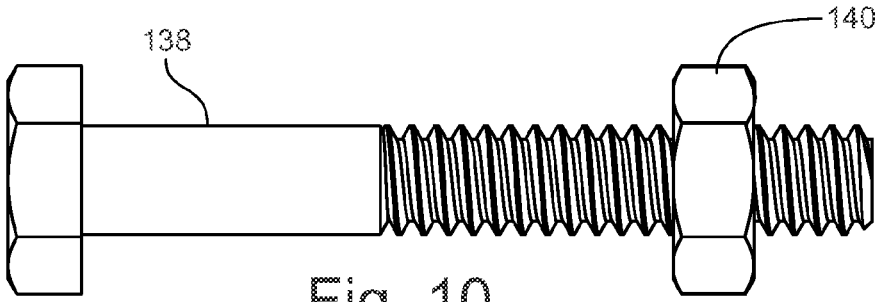
FIG. 10 is a side view of a bolt and nut.

Referring to FIGS. 7A-B, the location of non-recoiling mounting bracket 22 along the axis of recoil of apparatus 10 may be varied by varying gap G between first and second isolator brackets 116, 118. Gap G may be varied by threading adjustors 120 in isolator bracket 116. Adjustors 120 may be threaded in isolator bracket 116 by inserting, for example, a screwdriver in slot 126 of adjustor 120 (with washer 130 removed from that end of adjustor 120). The distance that adjustors 120 (with washers 130 disposed on their ends) protrude from surface 136 of isolator bracket 116 may determine gap G. When gap G is correctly set, conventional fasteners, for example, bolts 138 (FIG. 10) may be inserted through central bores 132 in washers 130, central bores 124 in adjustors 120, and fastener openings (not shown) in second isolator bracket 118. Nuts 140 (FIG. 10) may secure bolts 138 to second isolator bracket 118. Threaded adjustors 120 may provide a secure and continuous type of adjustment of gap G.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An electrical make-break connection for an apparatus having a recoiling portion and a non-recoiling portion, the connection comprising:

(A) a non-recoiling assembly fixed to the non-recoiling portion, the non-recoiling assembly including
  (i) a mounting bracket
  (ii) a contact assembly removably disposed in the mounting bracket, the contact assembly including
    (a) a housing with a generally conically-shaped female portion on a mating side thereof, a radially extending flange on an outer surface of the housing, and a tapered slot formed in the generally conically-shaped female portion;
    (b) at least one wave spring disposed between the mounting bracket and the radially extending flange;
    (c) at least one electrical contact pin disposed in the housing and biased outwardly by a spring;
  (iii) a pair of circumferentially spaced-apart pins fixed to the radially extending flange and partially disposed in the mounting bracket, the pair of pins having radial and axial clearance in the mounting bracket such that the contact assembly is radially and axially movable with respect to the mounting bracket; and (B) a recoiling assembly fixed to the recoiling portion, the recoiling assembly including
  (i) a mounting bracket;
  (ii) a contact assembly removably disposed in the mounting bracket, the contact assembly including
    (a) a housing with a generally conically-shaped male portion on a mating side thereof for engaging and disengaging with the generally conically-shaped female portion of the housing of the non-recoiling assembly, and a boss formed on the generally conically-shaped male portion for mating with the tapered slot;
    (b) at least one electrical contact disposed in the housing and operable to mate with the at least one electrical contact pin of the non-recoiling assembly.

2. The connection of claim 1, wherein the at least one wave spring biases the non-recoiling contact assembly housing toward the recoiling contact assembly.

3. The connection of claim 1, wherein the non-recoiling assembly includes an electrical contact switch and the recoiling assembly includes a corresponding contact switch surface and further wherein the contact switch closes when the non-recoiling assembly and the recoiling assembly are in a connected state.

4. The connection of claim 1, wherein at least one electrical contact pin includes a plurality of electrical contact pins and the at least one electrical contact includes a plurality of electrical contacts, the plurality of electrical contact pins being operable to mate with corresponding ones of the plurality of electrical contacts.

5. The connection of claim 1, wherein the contact assembly of the recoiling portion includes a face seal disposed on the mating side thereof, the at least one electrical contact extending through the face seal.

6. The connection of claim 5, wherein the contact assembly of the recoiling portion includes a cover fixed to the recoiling contact assembly housing with fasteners, the cover including an alignment opening.

7. The connection of claim 6, wherein the recoiling assembly includes an alignment pin disposed in the alignment opening and in the mounting bracket of the recoiling assembly.

8. The connection of claim 5, wherein the contact assembly of the recoiling portion includes a contact module adjacent the face seal, a cup adjacent the contact module, and a retaining pin that extends through the cup, the contact module and the face seal.

9. The connection of claim 8, wherein the cup is fixed to the recoiling contact assembly housing with a pin.

10. The connection of claim 8, wherein the retaining pin is fixed in place with a washer that bears on the face seal and a cotter pin.

11. The connection of claim 10, wherein the non-recoiling contact assembly housing includes a central opening for receiving the cotter pin and washer of the recoiling contact assembly.

12. The connection of claim 5, wherein the face seal is made of an electrically insulating material and the non-recoiling contact assembly housing is made of an electrically conductive material, the material of the face seal being more compliant than the material of the non-recoiling contact assembly housing.

13. The connection of claim 12, wherein the non-recoiling contact assembly housing includes a raised ridge disposed radially inward of the generally conically-shaped female portion, the raised ridge surrounding the at least one electrical contact pin.

14. The connection of claim 13, wherein the raised ridge elastically deforms the face seal when the non-recoiling assembly and the recoiling assembly are in a connected state.

15. The connection of claim 12, wherein the non-recoiling contact assembly includes an electrically insulating pin housing disposed around the at least one electrical contact pin, the pin housing including a ridge portion that surrounds the at least one electrical contact pin and protrudes outwardly with respect to an adjacent surface of the non-recoiling contact assembly housing.

16. The connection of claim 15, wherein the ridge portion elastically deforms the face seal when the non-recoiling assembly and the recoiling assembly are in a connected state.

17. The connection of claim 1, wherein the mounting bracket of the non-recoiling assembly is rotatably fixed to the non-recoiling portion of the apparatus.

18. The connection of claim 17, wherein the non-recoiling assembly includes a spring-loaded plunger for preventing rotation of the non-recoiling mounting bracket.

19. The connection of claim 17, wherein, when the non-recoiling assembly and the recoiling assembly are in a connected state, rotation of the non-recoiling mounting bracket causes the non-recoiling contact assembly to move away from the recoiling contact assembly.

20. The connection of claim 17, wherein the non-recoiling portion includes a hinge for rotatably mounting the non-recoiling mounting bracket.

21. The connection of claim 20, wherein the non-recoiling portion of the apparatus includes a first isolator bracket having the hinge fixed thereto, a second isolator bracket rigidly fixed to the non-recoiling portion of the apparatus, at least one adjustor in threaded engagement with the first isolator bracket, and at least one fastener that rigidly fixes the first isolator bracket to the second isolator bracket.

22. The connection of claim 21, wherein a gap between the first isolator bracket and the second isolator bracket, along a recoil axis of the apparatus, is adjustable by threading the at least one adjustor.

23. The connection of claim 22, wherein ends of the at least one adjustor include generally convex spherical surfaces, the connection further comprising washers disposed at the ends of the at least one adjustor, the washers having concave spherical surfaces for mating with the convex spherical surfaces of the at least one adjustor.

24. The connection of claim 23, wherein the at least one adjustor and the washers include central bores for receiving the at least one fastener that rigidly fixes the first isolator bracket to the second isolator bracket.

* * * * *